US007604227B2

(12) United States Patent
Moody

(10) Patent No.: US 7,604,227 B2
(45) Date of Patent: Oct. 20, 2009

(54) SYSTEM AND METHOD FOR IDENTIFYING ENVELOPE GROUPS

(75) Inventor: Jay T. Moody, Wayland, MA (US)

(73) Assignee: Vistaprint Technologies Limited, Hamilton (BM)

( * ) Notice: Subject to any disclaimer, the term of this patent is extended or adjusted under 35 U.S.C. 154(b) by 211 days.

(21) Appl. No.: 11/481,196

(22) Filed: Jul. 5, 2006

(65) Prior Publication Data

US 2008/0006980 A1 Jan. 10, 2008

(51) Int. Cl.
*B65H 39/00* (2006.01)

(52) U.S. Cl. ..... 270/58.06; 270/52.02; 270/52.03; 270/1.02

(58) Field of Classification Search ..... 270/1.02, 270/52.02, 52.03, 58.06; 53/411, 429, 460, 53/569

See application file for complete search history.

(56) References Cited

U.S. PATENT DOCUMENTS 3,983,679 A * 10/1976 Zemke ..... 53/397
4,063,398 A * 12/1977 Huffman ..... 53/412
4,688,715 A * 8/1987 Barr ..... 229/302
4,972,655 A * 11/1990 Ogawa ..... 53/155
5,085,417 A * 2/1992 Copham ..... 270/1.02
5,191,540 A * 3/1993 Ramsey ..... 700/221
5,403,398 A * 4/1995 Riess et al. ..... 118/681
5,794,409 A * 8/1998 Akridge et al. ..... 53/460
2006/0231997 A1* 10/2006 Meunier ..... 270/52.02

* cited by examiner

*Primary Examiner*—Gene Crawford
*Assistant Examiner*—Leslie A Nicholson, III
(74) *Attorney, Agent, or Firm*—Robert L. Dulaney; Jessica J. Costa

(57) ABSTRACT

Method for producing multiple small custom envelope jobs using a sheet fed envelope machine. Multiple different envelope jobs are provided as stacks of sheets of envelope stock to a high volume envelope machine for processing into folded envelopes. Each envelope job stack includes a first sheet that, when processed by the machine, yields an envelope with visually distinctive edges. At the output of the envelope machine, the group of envelopes in an envelope job is indicated by the distinctive envelopes formed from first sheets.

4 Claims, 3 Drawing Sheets

SYSTEM AND METHOD FOR IDENTIFYING ENVELOPE GROUPS

FIELD OF THE INVENTION

This invention relates to the creation and processing of folded envelopes.

BACKGROUND OF THE INVENTION

High volume envelope machines capable of accepting stacks of cut sheets of paper or other suitable envelope stock and performing cutting, gluing, and folding operations to produce hundreds of folded envelopes per minute are commercially available from various vendors, for example Winkler+Dünnebier AG. Typically, a human operator of the envelope machine will manually load stacks of envelope paper stock in the machine's feed mechanism and a human operator will manually remove the folded envelopes for packaging or other processing as they completed and made available by the machine.

High volume envelope machines are well suited for the production of long runs of thousands of identical envelopes, but these machines have not been considered practical or efficient for short envelope print jobs, for example a print job of 100 envelopes. It can be appreciated that if a machine were to be running at a rate that produces hundreds of envelopes each minute with every hundred envelopes produced being a different job printed with different information for a different customer, the operator could find it stressful, or impossible, to keep up with that production pace while still correctly locating and removing the set of folded envelopes associated with each individual envelope job for packaging or other processing.

Therefore, there is a need for an envelope production and processing method that is capable of assisting an envelope machine operator in quickly and efficiently identifying the beginning and end of each different envelope order such that the operator can reliably and quickly manually separate each envelope order for further processing.

SUMMARY

The present invention is directed at satisfying the need for guides and processes that facilitate the ability of an envelope machine operator to quickly identify groups of folded envelopes belonging to individual envelope orders.

In accordance with one aspect of the invention, multiple different envelope jobs are provided to an envelope machine as stacks of sheets of envelope stock. The first sheet of each envelope job stack yields an envelope with visually distinctive edges, such that the group of envelopes in an envelope job can be identified by their position between the envelope formed by the first sheet of the stack and the envelope formed by the first sheet of the next envelope job stack.

It is an advantage of the invention that the folded envelopes in an envelope order can be quickly identified.

It is another advantage of the invention that envelope machines having high envelope output rates can be employed to produce small envelope orders.

These and other objects, features and advantages of the invention will be better understood with reference to the accompanying drawings, description and claims.

DETAILED DESCRIPTION

Figure 1:
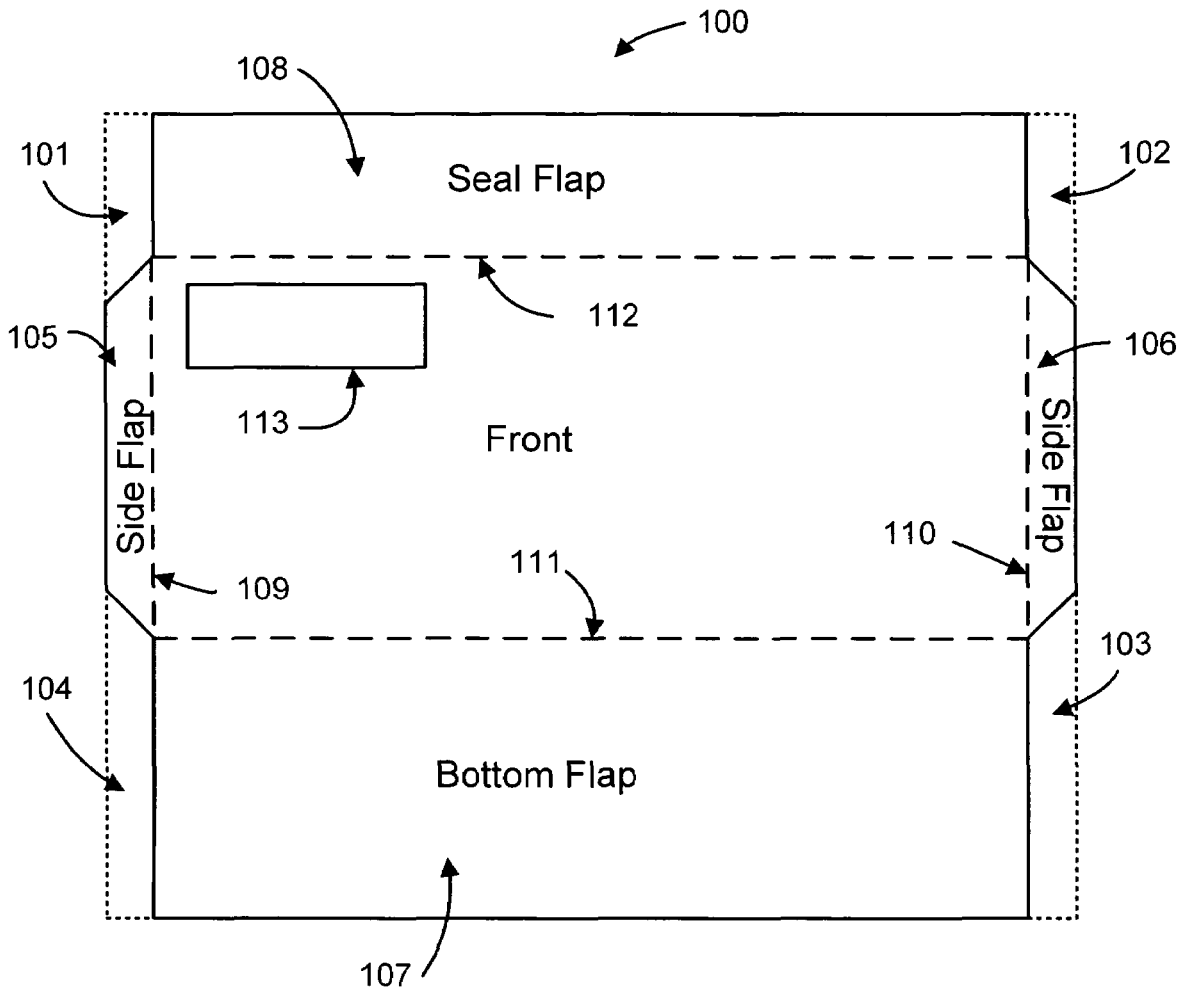
FIG. 1 illustrates the outside of an envelope prior to undergoing trimming, folding, and gluing.

FIG. 1 depicts sheet 100 prior to being processed into a finished envelope by trimming, gluing and folding. The envelope design and proportions depicted in FIG. 1 are merely representative for purposes of discussion. It will be understood by those of ordinary skill in the art that envelopes can be of various sizes, shapes, and materials and that the systems and methods disclosed herein are not limited to any particular envelope size, shape, material or trimming details. It will be further understood that envelopes are generally ordered in volume. In fulfilling an order for a requested quantity of custom envelopes, the appropriate number of sheets 100 with the customer's desired images and other information are printed and fed into the envelope machine for processing into folded envelopes. For custom printed envelopes, each sheet 100 is preprinted with return address information 113 and may also be preprinted with additional materials, not shown, such as images, graphics, patterns, or text.

In processing sheet 100 into a finished envelope, the areas identified as 101-104 of sheet 100 are cut away and discarded. The removal of areas 101-104 creates side flaps 105 and 106, bottom flap 107 and seal flap 108. During processing of sheet 100 by the envelope machine, side flaps 105 and 106 will be folded along the lines indicated by dashed lines 109 and 110, bottom flap 107 will be folded along the line indicated by dashed line 111, and seal flap 108 will be folded along the line indicated by dashed line 112. Adhesive is applied to firmly attach back flap 107 to side flaps 105 and 106. For the typical envelope for business and consumer use, an appropriate adhesive is applied to the appropriate side of seal flap 108 to allow the user of the envelope to seal the envelope after the user's materials have been placed inside.

Figure 2:
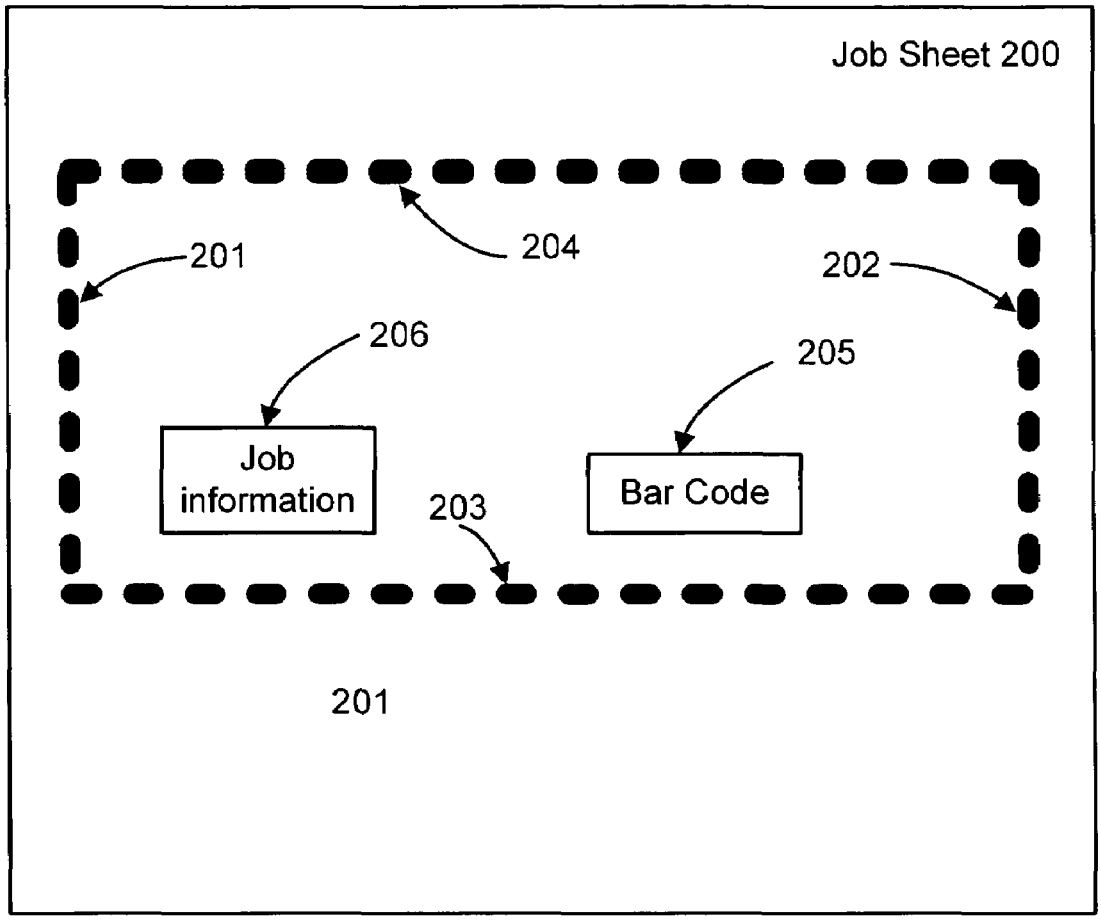
FIG. 2 is an illustrative envelope job sheet 200.

FIG. 2 depicts job sheet 200, which has been printed with indicators 201-204. Indicators 201-204 are relatively wide indicia printed at the envelope fold lines such that an envelope created from job sheet 200 will be visually distinctive from regular production envelopes and, therefore, will be readily identifiable by the machine operator. Indicators are positioned on job sheet 200 such that indicator 201 corresponds to the position of fold line 109, indicator 202 corresponds to the position of fold line 110, indicator 203 corresponds to fold line 111, and indicator 204 corresponds to fold line 112.

In the disclosed illustrative embodiment, job sheet 200 is also printed with bar code 205 having an individual envelope order identifier for order tracking and shipping purposes. Job sheet 200 may also have various additional printed content, collectively indicated in FIG. 2 as Job information 206, that the envelope manufacturer deems to be useful during the processing of the order. Job information 206 might include, for example, the order date, the envelope printing date, processing instructions, and/or customer information.

In addition to operating as an aid for post production identification and processing of envelope jobs, the bar code 205 and information 206 on the job sheet are also useful in the event of an envelope machine jam or other malfunction while envelope jobs are being produced. At the time of a malfunction, one or more different envelope jobs may be fully or partially in process in the machine and one or more sheets of envelope stock in one or more different envelope jobs may have been damaged or improperly processed such that the envelope job will need to be reprinted and reprocessed. The bar code 205 and information 206 allows the envelope manufacturer to quickly identify the damaged or potentially damaged jobs and initiate reprinting with a minimum of delay. For example, as sheets are being cleared from the machine by the operator after a jam or malfunction, the information 206 or the bar code 205 on the job sheets found in the machine can be read and those envelope jobs can be immediately scheduled to be reprinted such that the likelihood of the delivery to the customer being delayed is minimized.

Figure 3:
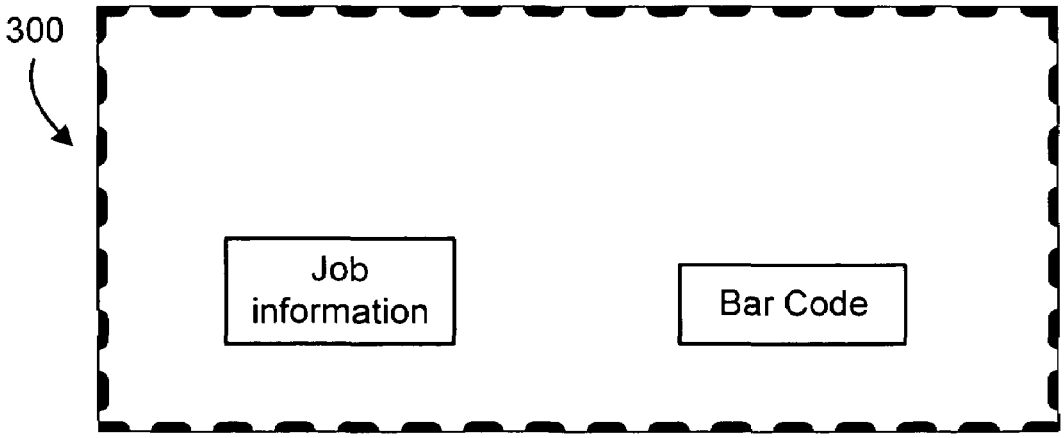
FIG. 3 depicts job sheet 200 after envelope processing.

FIG. 3 illustrates a folded envelope 300 produced from job sheet 200. Because indicators 201-204 were positioned to correspond to the locations of fold lines 109-112, indicators 201-204 will be wrapped over the edges of envelope 300 and will create a visually distinctive envelope 300 edge appearance that allows envelope 300 to be visually identified among a group of other envelopes.

While an alternating dark and light pattern is depicted herein as indicators 201-204, it will be understood that any other indicator design that is suitable to create a distinctive and easily recognized edge could be employed. For example, the envelope vendor may want to use the envelope created from job sheet 200 to further communicate with or market to the envelope customer by printing additional images and text on the job sheet and packaging the envelope created from the job sheet with the customer's envelopes. For example, content such as the logo of the envelope manufacturer, a thank you message, or a promotional offer for a future purchase, could be printed on sheet 200. Some of this additional image content could be specifically designed and positioned on job sheet 200 such that a portion of the image content crosses one or more of the fold lines 109-112 and yields a visually distinctive envelope edge that serves the function of indicators 201-204.

Figure 4:
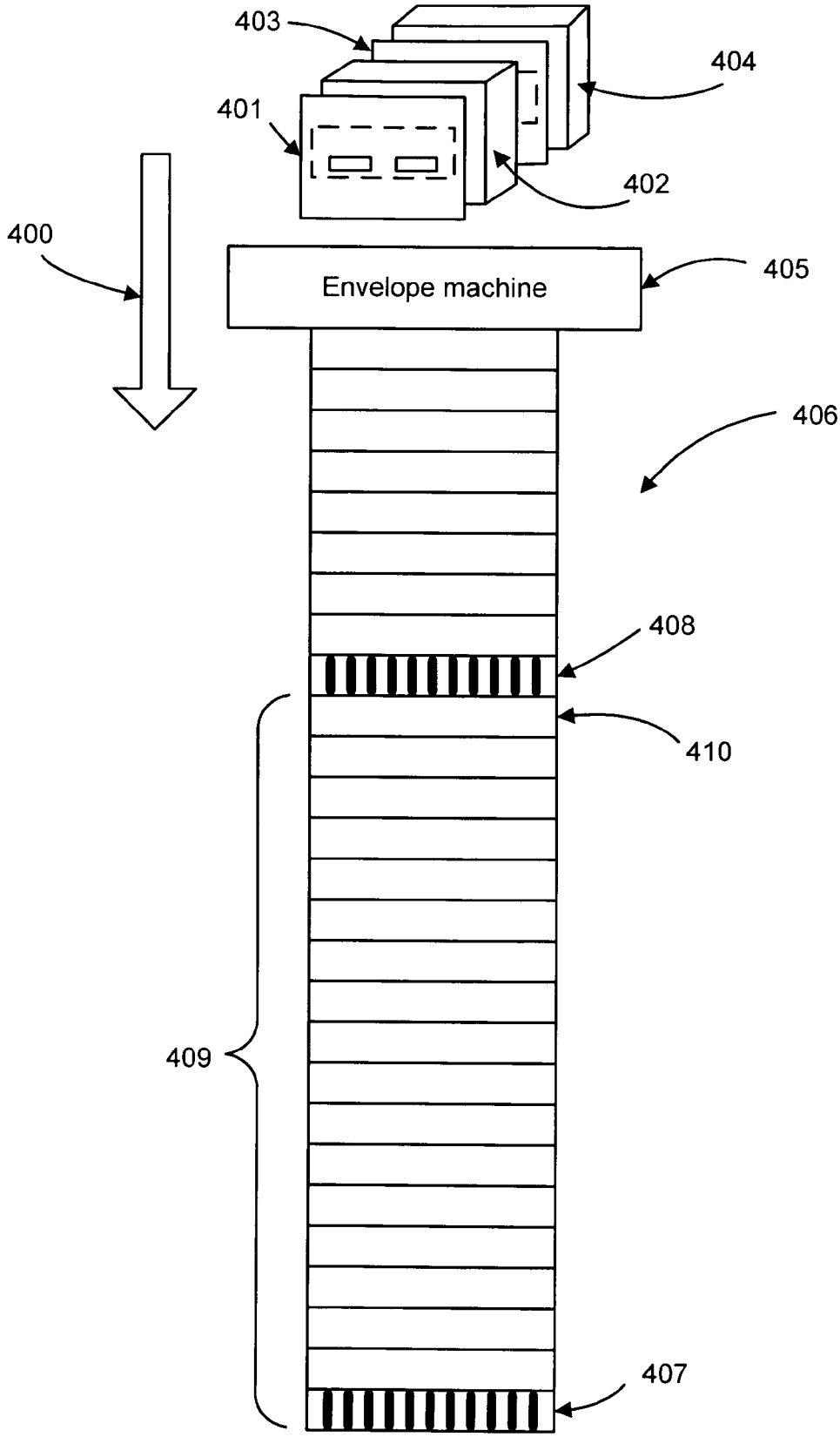
FIG. 4 is a schematic depiction of envelope processing flow using job sheets.

FIG. 4 shows an illustrative schematic representation of an envelope manufacturing process according to an embodiment of the invention. The process flow conceptually proceeds in the direction indicated by arrow 400. Each envelope job is fed into envelope machine 405 as a stack of preprinted sheets, such as envelope job stacks 402 and 404, for processing into folded envelopes. A preprinted job sheet, as discussed above in connection with FIG. 2, is positioned on top of the associated stack of preprinted sheets before the sheets are processed by the envelope machine. For example, in FIG. 4, job sheet 401 associated with stack 402 is positioned on top of the stack, job sheet 403 is positioned on top of its corresponding stack of printed sheets 404, and so forth. It will be understood that if the envelope manufacture has a large number of envelope jobs to produce, the envelope manufacturer may operate the envelope machine continuously for an extended period of time with the machine operator adding additional stacks of envelope jobs to the machine feed mechanism from time to time as required to maintain a continuous supply of input material to the machine such that many stacks are sequentially processed.

While machine 405 is operating, the folded envelopes produced by the machine are continuously being transferred by the machine into an output area that is accessible to an operator such that the operator can manual remove the envelopes for packaging or other interim processing. The envelopes produced by the machine are positioned by the machine in the machine's output area such that the edges of the folded envelopes are visible to the operator.

In the situation depicted in FIG. 4, a plurality of envelopes are available in output queue 406 for removal by an operator. While machine 405 is operating, unfolded sheets are continuously being fed into the machine and folded envelopes are continuously entering output queue 406. Because the physical space for the folded envelopes is limited, the operator must frequently remove envelope jobs from the queue. In output queue 406 depicted in FIG. 4, each rectangle, such as 410, represents an edge of a folded envelope. Envelopes created from job sheets, such as envelopes 407 and 408, can be quickly visually identified by the operator by their visually distinctive edges and serve as dividers between different envelope jobs.

Referring to FIG. 4, the operator can quickly view the output envelope queue 406 and see that all envelopes from 407 through 410 are a single envelope print job, with envelope 408 indicating the beginning of the next job. The operator can manually remove all envelopes 409 for packaging or other processing. Because the indicator is printed such that it appears on the top, sides and bottom edges of the folded envelope, any edge that is visible to the operator will provide the visual cue.

While an exemplary embodiment of the invention has been discussed, the described embodiment is to be considered as illustrative rather than restrictive. The scope of the invention is as indicated in the following claims and all equivalent methods and systems.

What is claimed is:

1. A method for the production of multiple different orders of custom folded envelopes, the method comprising:

for each respective order, producing a respective stack of sheets of envelope stock, the respective stack comprising a first sheet followed by a plurality of production sheets of envelope stock, the plurality of production sheets having identical content printed thereon, and the first sheet having an appearance that differs from the appearance of the production sheets such that when the respective stack of sheets of envelope stock is processed into folded envelopes, one or more edges of the envelope formed from the first sheet is visually distinctive from corresponding one or more edges of each of the envelopes formed from each of the production sheets;

providing the respective stacks of sheets of envelope stock to an envelope processing machine such that the envelope machine continuously processes the stacks of sheets into folded envelopes;

visually examining the envelopes produced by the envelope machine;

identifying groups of envelopes positioned between two envelopes formed from first sheets as corresponding to an envelope job; and manually removing the identified envelopes for further processing.

2. The method of claim 1 further comprising printing identifying information on each first sheet identifying at least the envelope job associated with the first sheet.

3. The method of claim 1 further comprising providing the envelope formed from the first sheet to the customer with the envelope job.

4. The method of claim 1, wherein the first sheet for the stack comprises printed indicia along at least a portion of each of the fold lines on the outer face of the envelope stock, at least a portion of the printed indicia remaining visible along the edges of the envelope formed from the first sheet.

* * * * *